US010166440B2

(12) United States Patent
Madson et al.

(10) Patent No.: US 10,166,440 B2
(45) **Date of Patent: *Jan. 1, 2019**

(54) GOLF BALL DIMPLE PROFILE

(71) Applicant: Acushnet Company, Fairhaven, MA (US)

(72) Inventors: Michael R. Madson, Easton, MA (US); Nicholas M. Nardacci, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/852,374

(22) Filed: Dec. 22, 2017

(65) Prior Publication Data

US 2018/0117420 A1 May 3, 2018

Related U.S. Application Data

(63) Continuation-in-part of application No. 15/784,286, filed on Oct. 16, 2017, which is a continuation-in-part of application No. 14/981,383, filed on Dec. 28, 2015, now Pat. No. 9,789,363, which is a continuation-in-part of application No. 14/159,755, filed on Jan. 21, 2014, now Pat. No. 9,220,945, which is a continuation-in-part of application No. 13/423,388, filed on Mar. 19, 2012, now Pat. No. 8,632,426, which is a continuation of application No. 12/407,824, filed on Mar. 20, 2009, now Pat. No. 8,137,217.

(51) Int. Cl.
*A63B 37/12* (2006.01)
*A63B 37/00* (2006.01)

(52) U.S. Cl.
CPC ..... *A63B 37/0004* (2013.01); *A63B 37/002* (2013.01); *A63B 37/0012* (2013.01); *A63B 37/0016* (2013.01); *A63B 37/0019* (2013.01)

(58) Field of Classification Search
CPC ..... A63B 37/0012
USPC ..... 473/383
See application file for complete search history.

(56) References Cited

U.S. PATENT DOCUMENTS

| | | | |
|---|---|---|---|
| 4,560,168 | A | 12/1985 | Aoyama |
| 4,840,381 | A | 6/1989 | Ihara et al. |
| 4,979,747 | A | 12/1990 | Jonkouski |
| 5,016,887 | A | 5/1991 | Jonkouski |
| 6,413,171 | B1 | 7/2002 | Shimosaka |
| 6,454,668 | B2 | 9/2002 | Kasashima et al. |

(Continued)

*Primary Examiner* — Raeann Gorden
(74) *Attorney, Agent, or Firm* — Mandi B. Milbank

(57) ABSTRACT

The present invention concerns a golf ball having dimples with a cross-sectional profile comprising a conical top portion and a non-conical bottom portion. More particularly, the profiles of the present invention are defined by three independent parameters: dimple diameter ($D_D$), edge angle ($\Phi_{EDGE}$), and saucer ratio ($S_r$). These parameters fully define the dimple shape and allow for greater flexibility in constructing a dimple profile versus conventional spherical dimples. Further, conical dimples provide a unique dimple cross-section which is visually distinct.

16 Claims, 17 Drawing Sheets

(56) References Cited

U.S. PATENT DOCUMENTS

| | | | | |
|---|---|---|---|---|
| 6,572,494 | B2 | 6/2003 | Emerson et al. | |
| 7,094,162 | B2 | 8/2006 | Sajima | |
| 7,207,905 | B2 | 4/2007 | Aoyama | |
| 8,137,217 | B2 | 3/2012 | Madson et al. | |
| 2018/0036595 | A1* | 2/2018 | Madson ..... | A63B 37/002 |

* cited by examiner

GOLF BALL DIMPLE PROFILE

CROSS-REFERENCE TO RELATED APPLICATIONS

This application is a continuation-in-part of U.S. patent application Ser. No. 15/784,286, filed Oct. 16, 2017, which is a continuation-in-part of U.S. patent application Ser. No. 14/981,383, filed Dec. 28, 2015, which is a continuation-in-part of U.S. patent application Ser. No. 14/159,755, filed Jan. 21, 2014, now U.S. Pat. No. 9,220,945, which is a continuation-in-part of U.S. patent application Ser. No. 13/423,388, filed Mar. 19, 2012, now U.S. Pat. No. 8,632,426, which is a continuation of U.S. patent application Ser. No. 12/407,824, filed Mar. 20, 2009, now U.S. Pat. No. 8,137,217, the entire disclosures of which are hereby incorporated herein by reference.

FIELD OF THE INVENTION

The present invention relates to a golf ball, and more particularly, to the cross-sectional profile of dimples on the surface of a golf ball.

BACKGROUND OF THE INVENTION

Golf balls were originally made with smooth outer surfaces. In the late nineteenth century, players observed that the guttie golf balls traveled further as they got older and more gouged up. The players then began to roughen the surface of new golf balls with a hammer to increase flight distance. Manufacturers soon caught on and began molding non-smooth outer surfaces on golf balls.

By the mid 1900's, almost every golf ball being made had 336 dimples arranged in an octahedral pattern. Generally, these balls had about 60 percent of their outer surface covered by dimples. Over time, improvements in ball performance were developed by utilizing different dimple patterns. In 1983, for instance, Titleist introduced the TITLEIST 384, which had 384 dimples that were arranged in an icosahedral pattern. About 76 percent of its outer surface was covered with dimples. Today's dimpled golf balls travel nearly two times farther than a similar ball without dimples.

The dimples on a golf ball are important in reducing drag and increasing lift. Drag is the air resistance that acts on the golf ball in the opposite direction from the ball flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. At some point it separates from the surface of the ball, leaving a large turbulent flow area called the wake that has low pressure. The difference in the high pressure in front of the ball and the low pressure behind the ball slows the ball down. This is the primary source of drag for a golf ball.

The dimples on the ball create a turbulent boundary layer around the ball, i.e., the air in a thin layer adjacent to the ball flows in a turbulent manner. The turbulence energizes the boundary layer and helps it stay attached further around the ball to reduce the area of the wake. This greatly increases the pressure behind the ball and substantially reduces the drag.

Lift is the upward force on the ball that is created from a difference in pressure on the top of the ball to the bottom of the ball. The difference in pressure is created by a warpage in the air flow resulting from the ball's back spin. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Almost every golf ball manufacturer researches dimple patterns in order to increase the distance traveled by a golf ball. A high degree of dimple coverage is beneficial to flight distance, but only if the dimples are of a reasonable size. Dimple coverage gained by filling spaces with tiny dimples is not very effective, since tiny dimples are not good turbulence generators.

In addition to researching dimple pattern and size, golf ball manufacturers also study the effect of dimple shape, volume, and cross-section on overall flight performance of the ball. Conventional dimples are the shape of a section of a sphere. These profiles rely on essentially two independent parameters to fully define the dimple shape: diameter and depth (chordal or surface). Edge angle is often discussed when describing spherical dimple profiles but is not independent of diameter and depth. However, it is more commonly used in place of depth when describing spherical dimple shapes. Spherical dimples have a volume ratio ($V_R$) around 0.5 (see below for definition). For purposes of aerodynamic performance, it is desirable to have additional control of dimple shape by varying edge angle independently from dimple diameter and depth. This has been achieved in a number of ways. Examples include "dual radius," dimple within a dimple, and catenary dimple profiles. These cross-sections allow for more control over spherical cross-sections and allow one to vary $V_R$ to optimize aerodynamic performance. With the exception of catenary profiles, the mathematical descriptions are cumbersome or do not result in smooth continuous dimple profiles.

Several patents relate golf ball manufacturers' attempts to construct improved non-spherical golf ball dimples. U.S. Pat. No. 7,094,162 discloses a golf ball dimple comprising a top truncated cone part and a bottom bowl-shaped part. However, this dimple has a sharp demarcation line between these two portions of the dimples which shows a great distinction between them. U.S. Pat. Nos. 4,560,168, 4,970,747, 5,016,887, and 6,454,668 mention dimples having a frusto-conical or truncated cone portion but do not combine that with a bottom spherical portion.

Thus, there still remains a need to construct dimples with a conical portion having a smooth continuous profile and improved aerodynamic performance.

SUMMARY OF THE INVENTION

The present invention is directed to a golf ball dimple comprising a top conical sidewall and a bottom portion, and having a saucer ratio ($S_r$), defined as the ratio of the bottom portion diameter ($D_S$) to the dimple diameter ($D_D$), of from about 0.05 to about 0.75. The bottom portion is defined by a function rotated about a central axis, the function being selected from the group consisting of polynomial, trigonometric, hyperbolic, exponential functions, and the superposition of two or more thereof. Excluded are linear functions and functions that result in a cone or sphere.

The present invention is also directed to a golf ball having a generally spherical surface and comprising a plurality of dimples separated by a land area formed on the surface. At least a portion of the dimples consist of a top conical sidewall and a bottom portion and have a saucer ratio ($S_r$), defined as the ratio of the bottom portion diameter ($D_S$) to the dimple diameter ($D_D$), of from about 0.05 to about 0.75. The bottom portion is defined by a function rotated about a central axis, the function being selected from the group consisting of polynomial, trigonometric, hyperbolic, exponential functions, and the superposition of two or more thereof. Excluded are linear functions and functions that result in a cone or sphere.

In a particular embodiment, dimples of the present invention have an edge angle ($\Phi_{EDGE}$) defined by $$1.33(S_r)^2-0.39(S_r)+10.40 \leq \Phi_{EDGE} \leq 2.85(S_r)^2-1.12(S_r)+13.49.$$

In another particular embodiment, dimples of the present invention have a chord depth ($d_{CHORD}$) defined by $$0.0009(S_r)^2-0.0035(S_r)+0.0062 \leq d_{CHORD} \leq 0.0030(S_r)^2-0.0069(S_r)+0.0113.$$

In another particular embodiment, dimples of the present invention additionally comprise a transition surface that connects the top conical sidewall to the land area, and have a transition ratio ($T_r$) of from 0.02 to 0.50, where the transition ratio ($T_r$) is defined by the equation $T_r=1-(D_T/D_D)$, where $D_D$ is the dimple diameter and $D_T$ is the diameter at the point of intersection between the transition surface and the top conical sidewall. In a particular aspect of this embodiment, the transition surface is defined by a circular arc rotated about a central axis. In another particular aspect of this embodiment, the transition surface is defined by a linear function rotated about a central axis.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION

The present invention concerns a golf ball with dimples comprising a top conical sidewall and a non-conical bottom portion. In one embodiment, the bottom portion is a spherical cap with a prescribed point of tangency to the conical sidewall. In another embodiment, the bottom portion is defined by a function selected from the group consisting of polynomial, trigonometric, hyperbolic, exponential functions, and the superposition of two or more thereof, excluding linear functions and functions that result in a cone or sphere when rotated about a central axis. Functions resulting from the superposition of two or more different functions, and the use thereof for dimple profiles, are further disclosed, for example, in U.S. Patent Application Publication No. 2012/0165130 to Madson et al. and U.S. Patent Application Publication No. 2013/0172125 to Nardacci et al., the entire disclosures of which are hereby incorporated herein by reference.

The profiles of the present invention are further defined by three parameters: dimple diameter ($D_D$), edge angle ($\Phi_{EDGE}$), and saucer ratio ($S_r$). These parameters fully define the dimple shape and allow for greater flexibility in constructing a dimple profile versus conventional spherical dimples. Further, conical dimples provide a unique dimple cross-section which is visually distinct.

Figure 1:
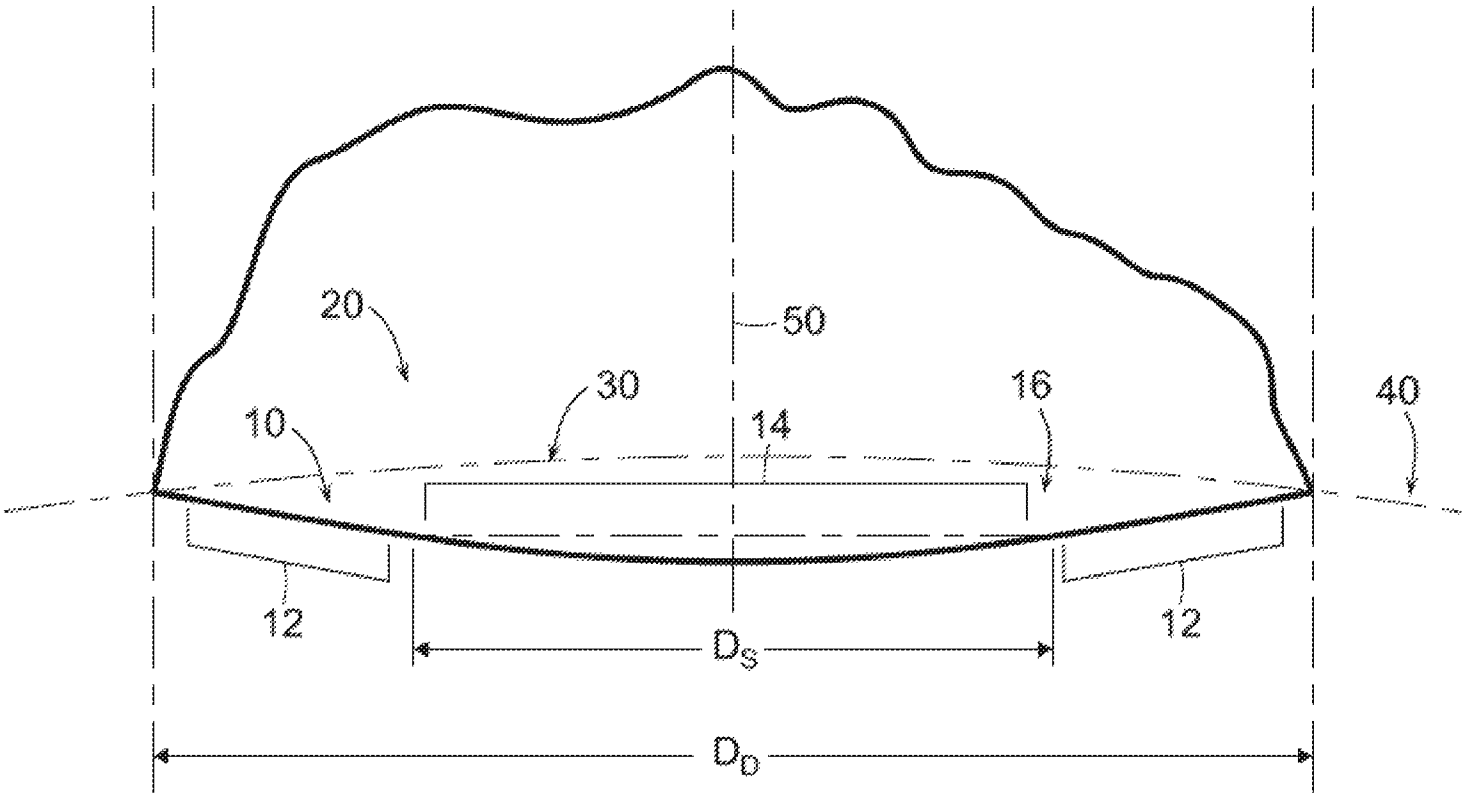
FIG. 1 is a schematic diagram illustrating a dimple profile according to this invention.

FIG. 1 is a cross-sectional view illustrating a dimple 10 on a golf ball 20 having an outer spherical surface with a phantom portion 30 and an undimpled land area 40. A rotational axis 50 vertically traverses the center of dimple 10. The dimple 10 comprises a top conical edge 12 (an edge with no radius) and a bottom spherical cap 14. More particularly, the dimple diameter ($D_D$) that defines the phantom spherical outer surface 30 acts as the base of a right circular cone. From that base, a conical edge 12 forms the top portion of the dimple 10. The bottom of dimple 10 is defined by a spherical cap 14. The diameter of the bottom spherical cap 14 is also referred to as the saucer diameter ($D_S$) and is preferably concentric with the dimple diameter ($D_D$).

In one innovative aspect of the present invention, dimple 10 has a defined tangent point 16, wherein the straight conical edge 12 meets the spherical bottom cap 14. The tangent point 16 is determined by the saucer diameter ($D_S$) and the edge angle ($\Phi_{EDGE}$) of the dimple, which is defined below. At the defined tangent point 16, the difference in the slope of the straight conical edge 12 and the slope of the spherical arcuate cap 14, which is the slope of a line tangent to cap 14 at point 16, will be less than 2°, preferably less than 1°, and more preferably the slopes will be about equal at that connection to ensure tangency at that location.

The ultimate shape of dimple 10 is defined by three parameters. The first of these parameters is the dimple diameter ($D_D$), and the second of these parameters is the saucer ratio ($S_r$), which is defined by equation (1):

$$S_r = D_S/D_D \quad (1)$$

If $S_r=0$, then the dimple would be a cone with no spherical bottom radius, and if $S_r=1$, then the dimple is spherical. For the purpose of this invention, the value of $S_r$ preferably falls in the range of about $0.05 \le S_r \le 0.75$, preferably about $0.10 \le S_r \le 0.70$, more preferably about $0.15 \le S_r \le 0.65$, more preferably about $0.20 \le S_r \le 0.60$, more preferably about $0.25 \le S_r \le 0.55$, more preferably about $0.30 \le S_r \le 0.50$, and more preferably about $0.35 \le S_r \le 0.45$. If $S_r$ is less than 0.05 then the manufacturing of dimple 10 becomes more difficult, and the sharp point at the bottom of the dimple can diminish the aerodynamic qualities of golf ball 20 and is susceptible to paint flooding. If $S_r$ is greater than 0.75 then it too closely resembles the shape of a spherical dimple and the qualities of conical dimples to adjust the flight performance of the golf ball 20 is diminished.

Figure 2:
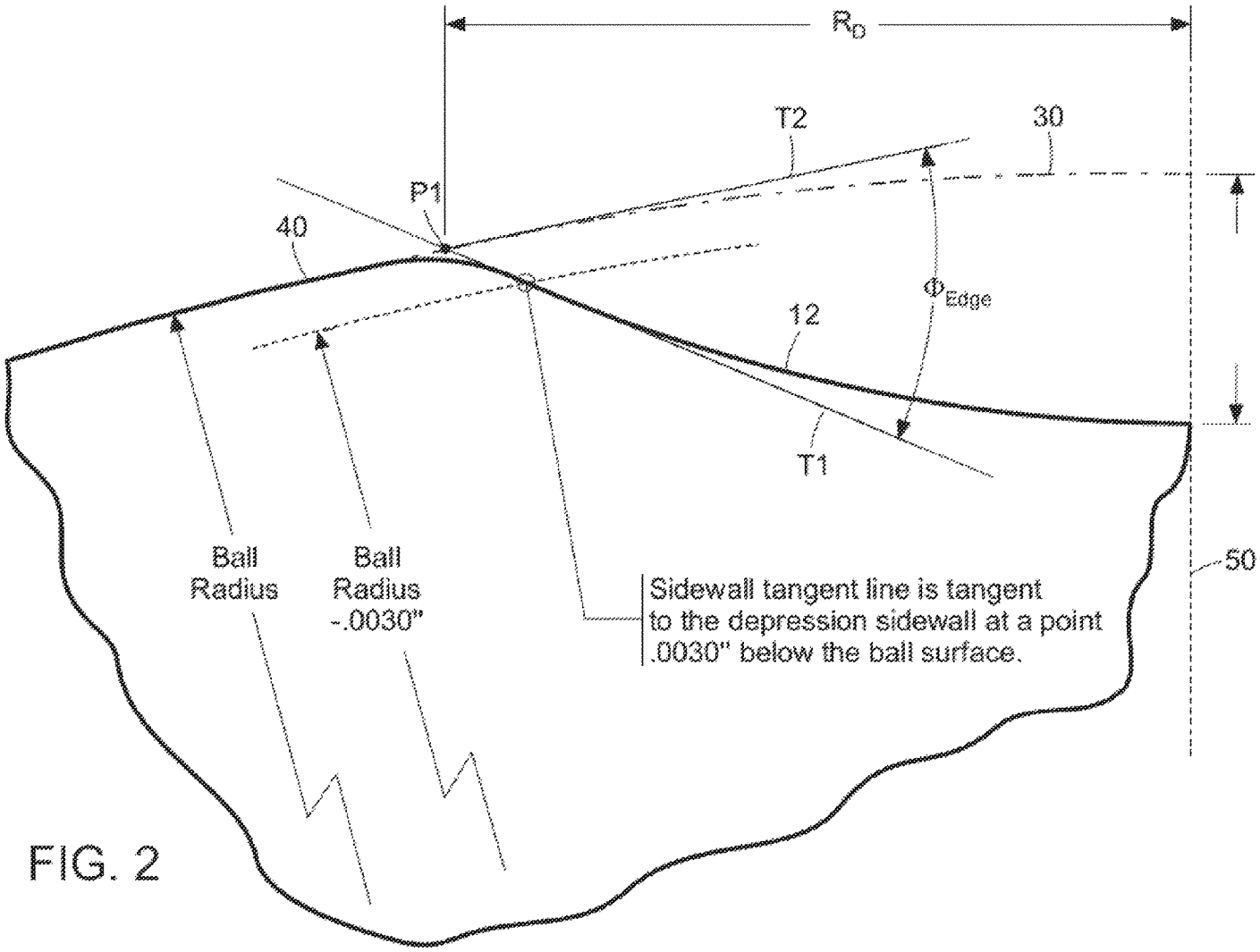
FIG. 2 is a schematic diagram illustrating a method for measuring the edge angle of a dimple.

The third parameter to adjust the dimple shape can either be the edge angle ($\Phi_{EDGE}$) or the chord depth ($d_{CHORD}$). Both parameters are dependent upon one another. The edge angle ($\Phi_{EDGE}$) is defined as the angle between a first tangent line T1 and a second tangent line T2, which can be measured as shown in FIG. 2. Generally, it may be difficult to define and measure an edge angle ($\Phi_{EDGE}$) due to the indistinct nature of the boundary dividing the dimple 10 from the ball's undisturbed land surface 40. Due to the effects of the paint and/or the dimple design itself, the junction between the land surface and dimple is not a sharp corner and is therefore indistinct. This can make the measurement of a dimple's edge angle ($\Phi_{EDGE}$) and radius ($R_D$) somewhat ambiguous. Thus, as shown in FIG. 2, to resolve this problem, a ball phantom surface 30 is constructed above the dimple 10 as a continuation of land surface 40.

In FIG. 2, first tangent line T1 is a line that is tangent to conical edge 12 at a point P2 that is spaced about 0.0030 inches radially inward from the phantom surface 30. T1 intersects phantom surface 30 at a point P1, which defines a nominal edge position. The second tangent line T2 is constructed as being tangent to the phantom surface 30 at P1. The edge angle is the angle between T1 and T2. The point P1 can also be used to measure the dimple radius ($R_D$) to be the distance from P1 to the rotational axis 50.

Figure 10:
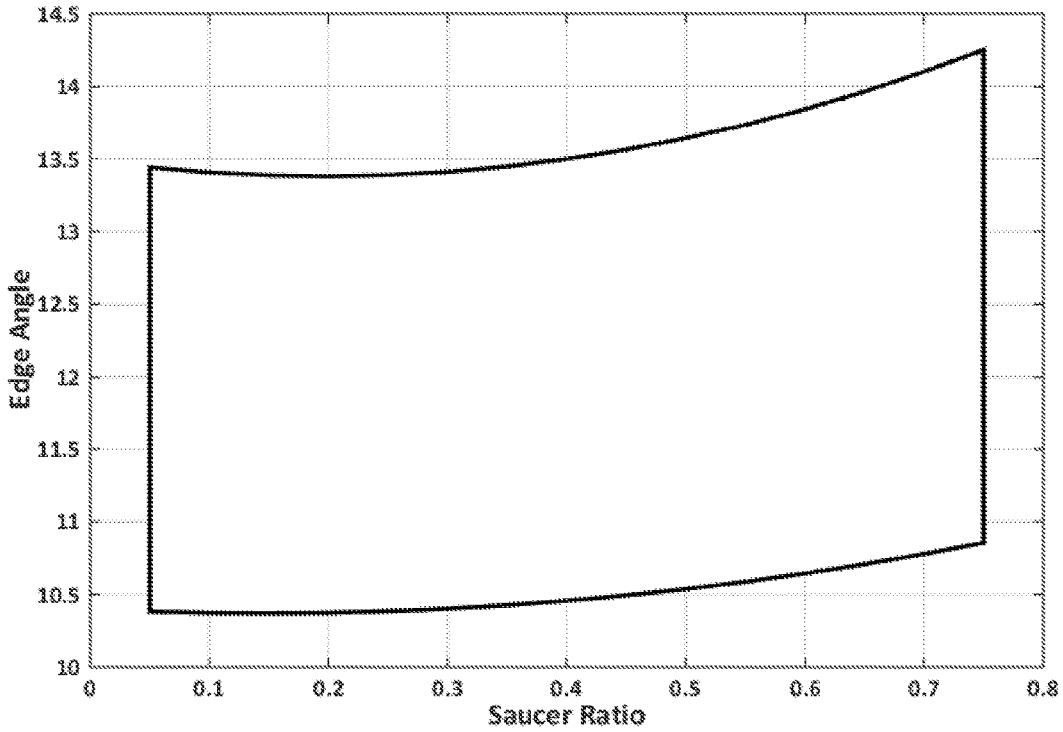
FIG. 10 is a graphical representation of the relationship between saucer ratio and edge angle according to an embodiment of the present invention.

FIG. 10 is a graphical representation of the relationship between saucer ratio and edge angle according to an embodiment of the present invention. In a particular embodiment, dimples of the present invention have an edge angle ($\Phi_{EDGE}$) defined by $$1.33(S_r)^2 - 0.39(S_r) + 10.40 \le \Phi_{EDGE} \le 2.85(S_r)^2 - 1.12(S_r) + 13.49.$$

Figure 3:
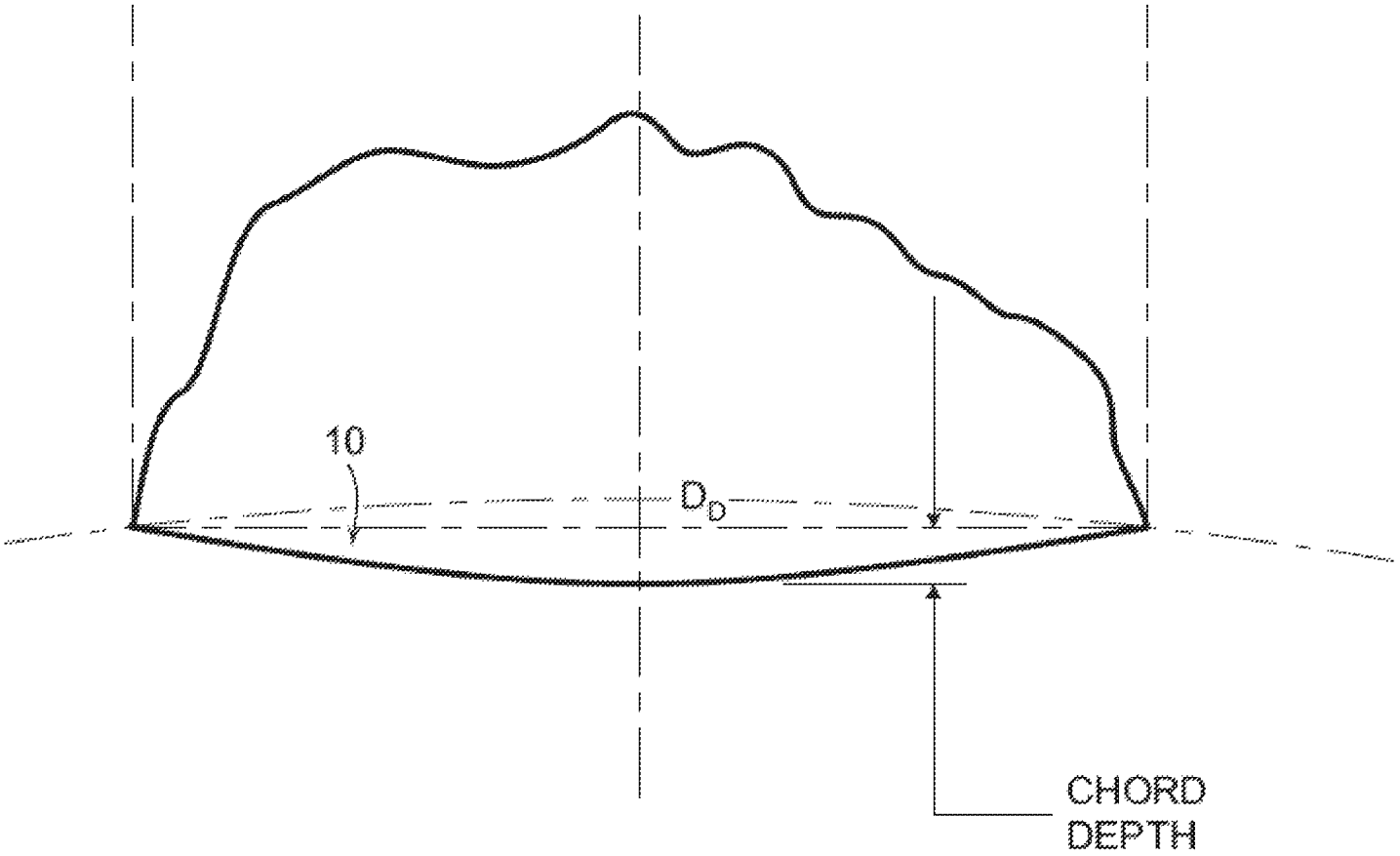
FIG. 3 is a schematic diagram illustrating a method for measuring the chord depth of a dimple.

FIG. 3 illustrates a method of measuring the chord depth ($d_{CHORD}$). As illustrated therein, the chord depth ($d_{CHORD}$) is measured as the distance from the theoretical cone base, denoted by the line marking dimple diameter ($D_D$), to the bottom of the dimple.

With a desired chord depth ($d_{CHORD}$), the edge angle ($\Phi_{EDGE}$) can be calculated by equation (2):

$$\Phi_{EDGE} = \Phi_{CAP} + \Phi_{CHORD} \quad (2)$$

Where: $\Phi_{CAP} = \sin^{-1}(D_D/D_B)$ $$\Phi_{CHORD} = \tan^{-1}\{(d_{CHORD} - d_{SAUCER}) \div (R_D - R_S)\}$$

And: $D_B$=Diameter of the golf ball $R_D$=Dimple radius, ($D_D/2$)

$R_S$=Saucer radius, ($D_S/2$)

$$d_{SAUCER} = \text{saucer depth} = r_{APEX} - \sqrt{(r_{APEX}^2 - R_S^2)}$$

$$r_{APEX} = R_S/\sin(\Phi_{CHORD})$$

Alternatively, if the edge angle ($\Phi_{EDGE}$) is known then the chord depth ($d_{CHORD}$) can be calculated by equation (3):

$$d_{CHORD} = d_{SAUCER} + (R_D - R_S) \times \tan[\Phi_{EDGE} - \{\cos^{-1}(D_D/D_B)\}] \quad (3)$$

Figure 11:
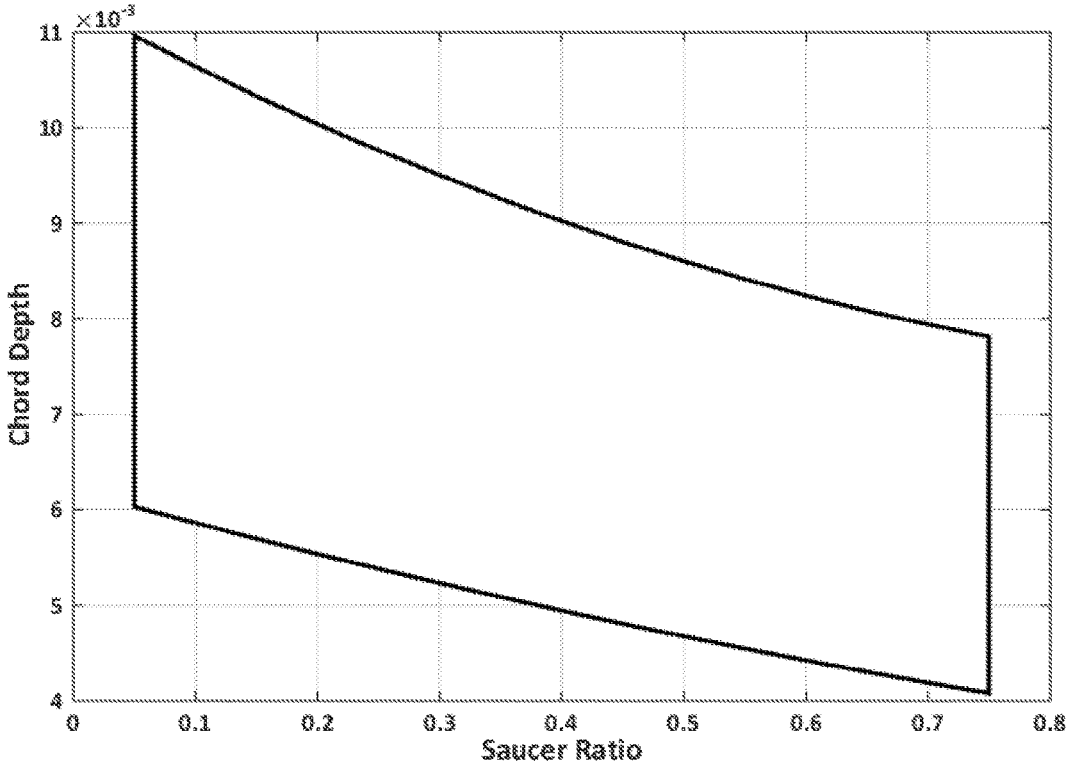
FIG. 11 is a graphical representation of the relationship between saucer ratio and chord depth according to an embodiment of the present invention.

FIG. 11 is a graphical representation of the relationship between saucer ratio and chord depth according to an embodiment of the present invention. In a particular embodiment, dimples of the present invention have a chord depth ($d_{CHORD}$) defined by $$0.0009(S_r)^2 - 0.0035(S_r) + 0.0062 \le d_{CHORD} \le 0.0030(S_r)^2 - 0.0069(S_r) + 0.0113.$$

The dimple 10 also has a volume ratio ($V_R$), which is the ratio between the dimple volume ($V_D$) and the theoretical cylindrical volume ($V_C$). In other words, $V_R = V_D : V_C$. The volume ratio ($V_R$) preferably falls in the range of about $\frac{1}{3} \le V_R \le \frac{1}{2}$. The dimple volume ($V_D$) can be calculated by equation (4):

$$V_D = [\tfrac{1}{3}\pi R_D^2(d_{CHORD})] - [\tfrac{1}{3}\pi R_S^2(d_{SAUCER})] + [\pi(d_{SAUCER})(3R_S^2 + d_{SAUCER}^2) \div 6] \quad (4)$$

The theoretical cylindrical volume ($V_C$) is the volume of a theoretical cylinder having a base diameter equal to that of the dimple diameter ($D_D$) and a height equal to the chord depth ($d_{CHORD}$) such that $V_C$ is calculated by equation (5):

$$V_C = \pi R_D^2(d_{CHORD}) \quad (5)$$

Figure 12:
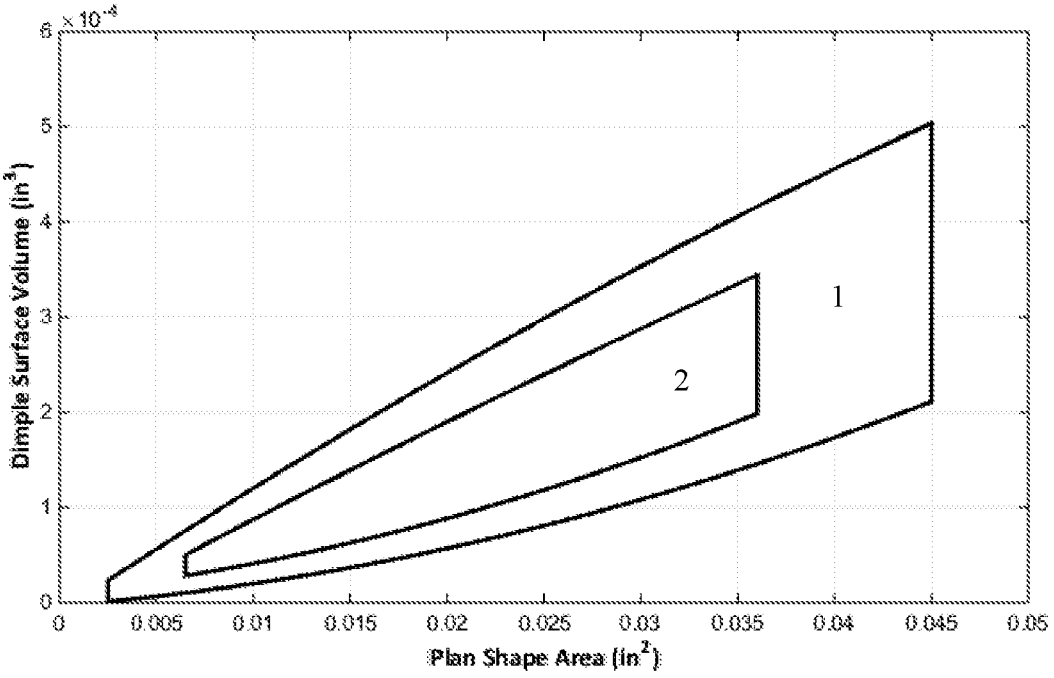
FIG. 12 is a graphical representation of the relationship between dimple volume and plan shape area according to an embodiment of the present invention.

FIG. 12 is a graphical representation of the relationship between dimple volume and plan shape area according to an embodiment of the present invention. For purposes of the present invention, the plan shape area is calculated as $\pi(D_D/2)^2$. In a particular embodiment, dimples produced in accordance with the present invention have a plan shape area and dimple volume within a range having a lower limit and an upper limit selected from the values within region 1 of FIG. 12. In another embodiment, dimples produced in accordance with the present invention have a plan shape area and dimple volume within a range having a lower limit and an upper limit selected from the values within region 2 of FIG. 12.

Figure 4:
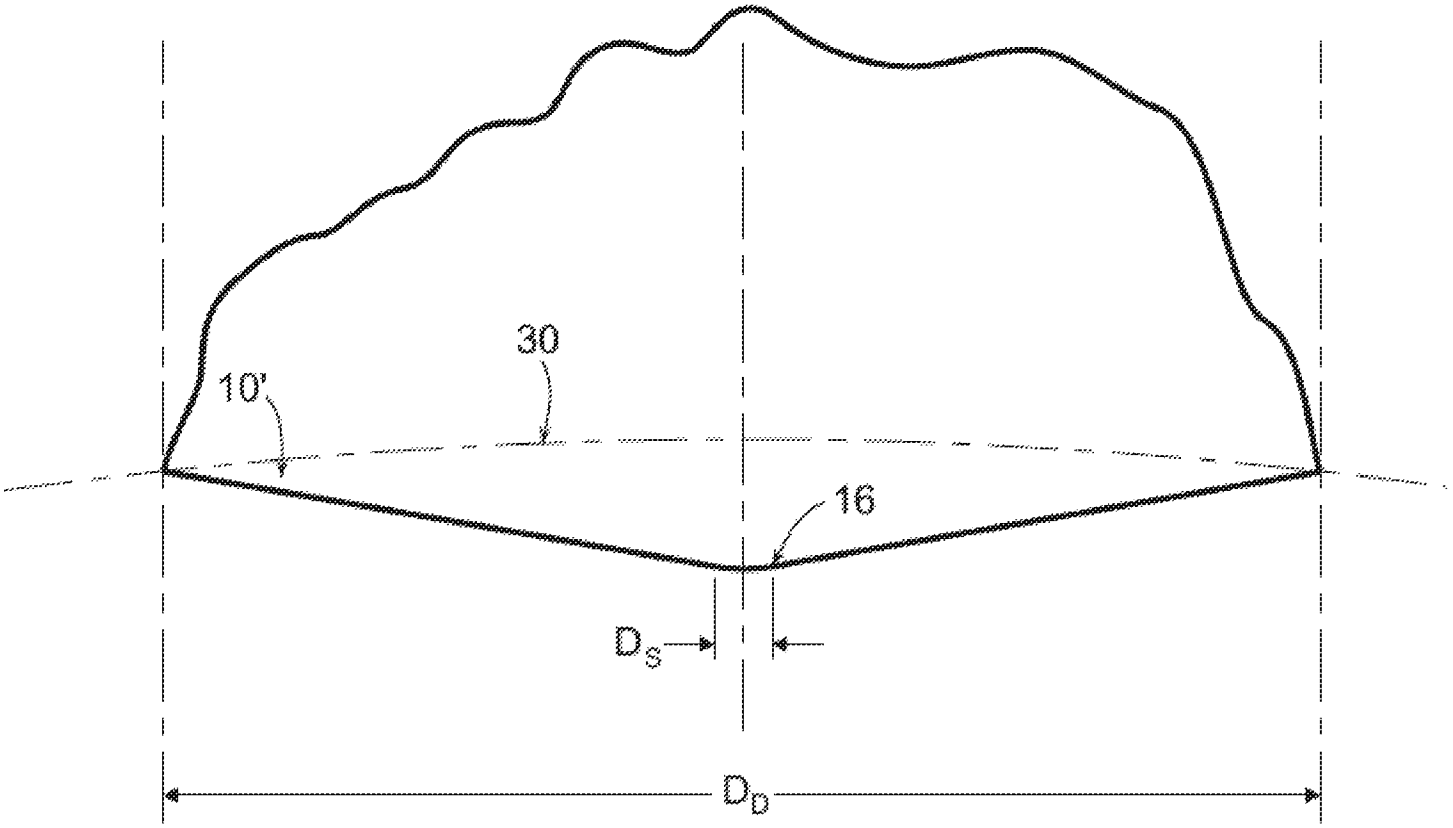
FIG. 4 is a schematic diagram illustrating another dimple profile according to this invention.
Figure 5:
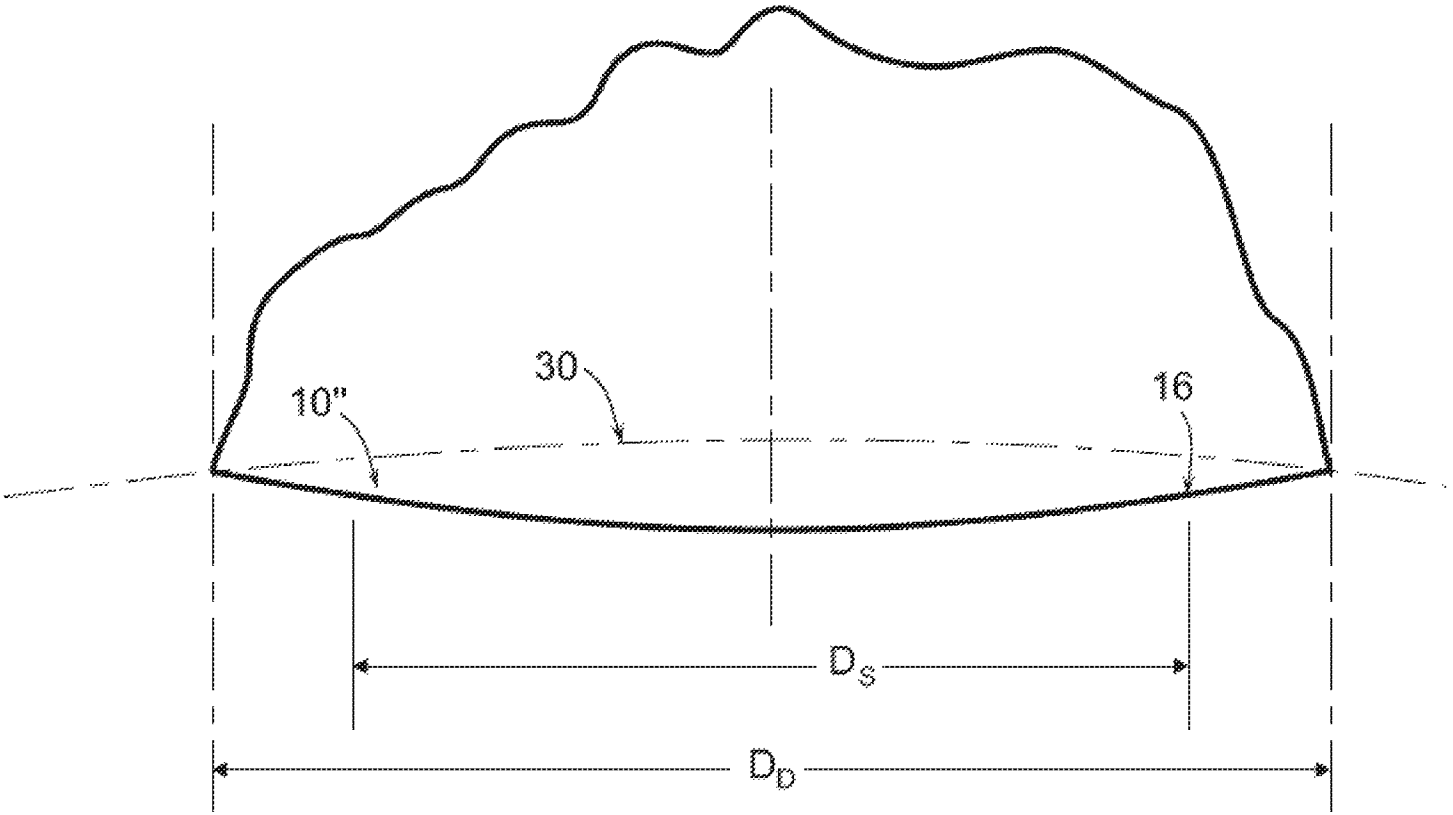
FIG. 5 is a schematic diagram illustrating another dimple profile according to this invention.

FIGS. 4 and 5 are illustrative examples of different dimple shapes 10' and 10", respectively, in accordance with the present invention, wherein the saucer ratio ($S_r$) is changed but the edge angle ($\Phi_{EDGE}$) remains constant at a value of about 16°. More particularly, in FIG. 4, dimple 10' has a saucer ratio ($S_r$) of about 0.05, a chord depth ($d_{CHORD}$) of about 0.0152 in., and a volume ratio ($V_R$) of about 0.341. By way of comparison, FIG. 5 illustrates a dimple 10" with a saucer ratio ($S_r$) of about 0.75, a chord depth ($d_{CHORD}$) of about 0.0097 in, and a volume ratio ($V_R$) of about 0.403.

Figure 9A:
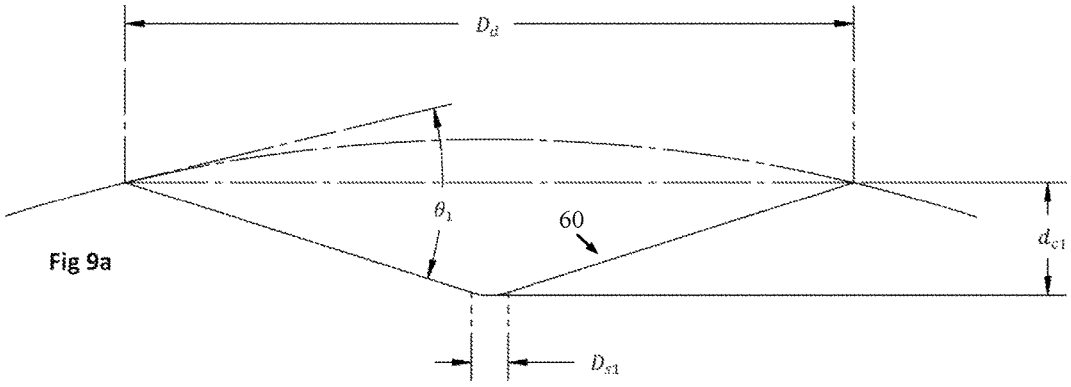
FIG. 9A is a schematic diagram illustrating a dimple profile according to an embodiment of the present invention.

FIG. 9A is an illustrative example of dimple shape 60, according to an embodiment of the present invention, having a top conical edge and a bottom portion defined by a polynomial function. Dimple shape 60 has a dimple diameter ($D_d$), a saucer diameter ($Ds_1$), an edge angle ($\theta_1$), and a chord depth ($d_{c1}$). The saucer ratio of dimple shape 60, defined by $D_{S1}/D_d$, of dimple shape 60 is about 0.05.

Figure 9B:
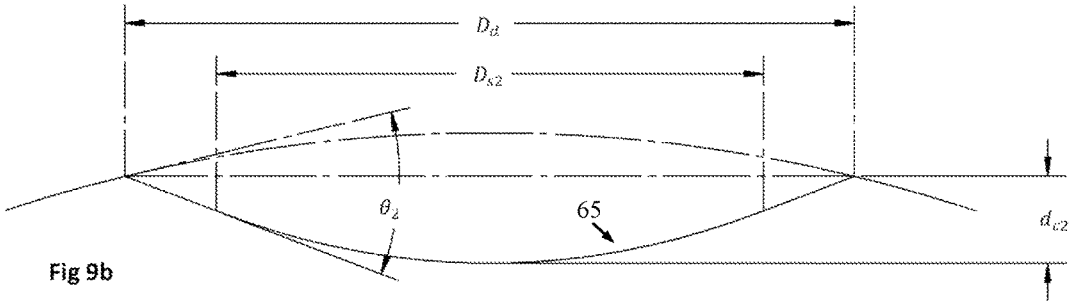
FIG. 9B is a schematic diagram illustrating a dimple profile according to an embodiment of the present invention.

FIG. 9B is an illustrative example of dimple shape 65, according to an embodiment of the present invention, having a top conical edge and a bottom portion defined by a polynomial function. Dimple shape 65 has a dimple diameter ($D_d$), a saucer diameter ($Ds_2$), an edge angle ($\theta_2$), and a chord depth ($d_{c2}$). The saucer ratio of dimple shape 65, defined by $D_{S2}/D_d$, of dimple shape 65 is about 0.75.

Figure 9C:
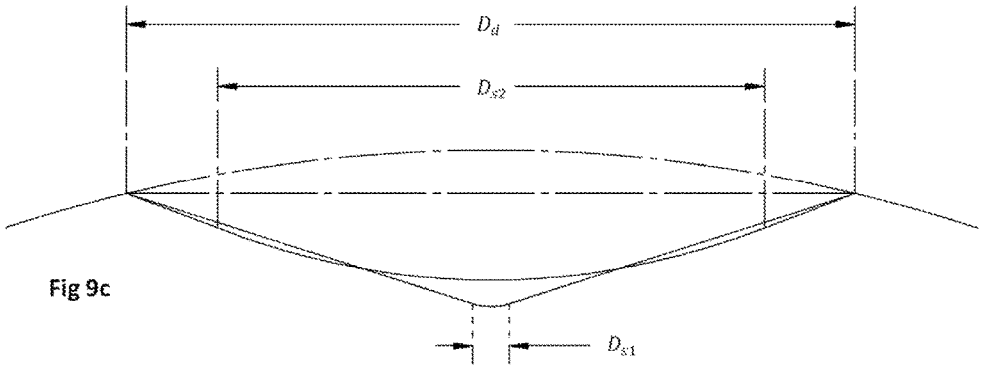
FIG. 9C is a schematic diagram illustrating two dimple profiles according to embodiments of the present invention.

FIG. 9C shows an overlay of the dimple shape 60 of FIG. 9A and the dimple shape 65 of FIG. 9B to illustrate the effect that a change in saucer ratio may have on edge angle and chord depth, particularly showing that $\theta_1<\theta_2$ and $d_{c1}>d_{c2}$.

Figure 6:
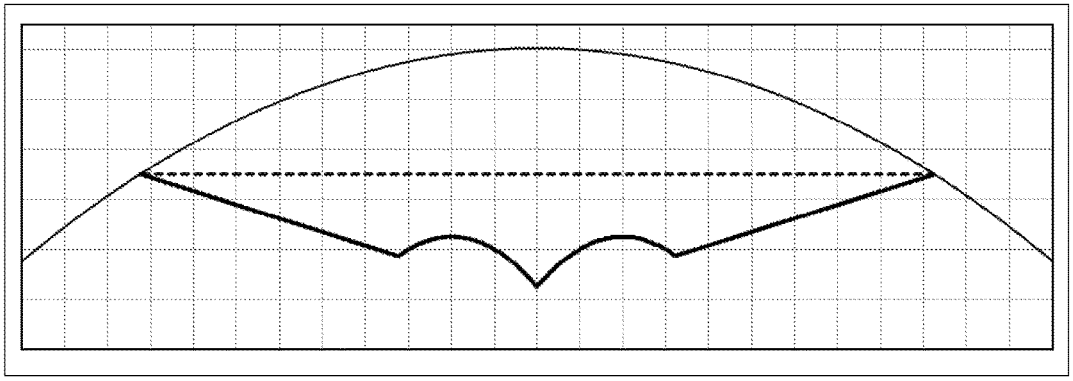
FIG. 6 shows a dimple cross-sectional shape according to an embodiment of the present invention.
Figure 7:
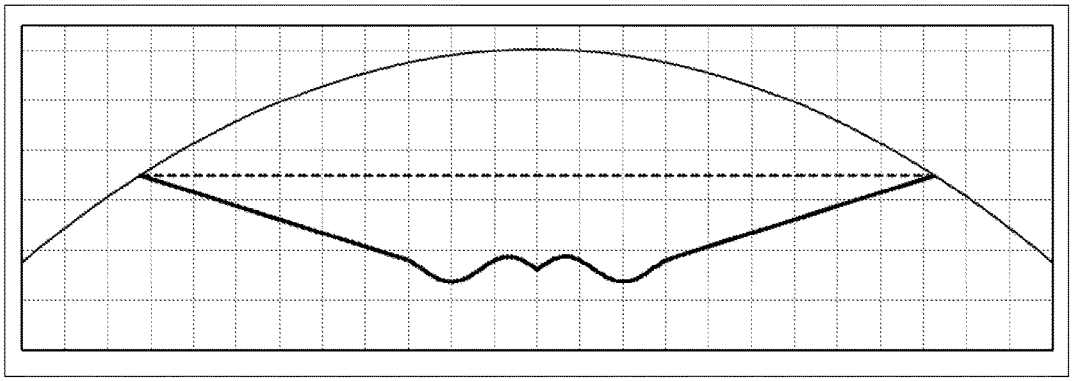
FIG. 7 shows a dimple cross-sectional shape according to another embodiment of the present invention.
Figure 8:
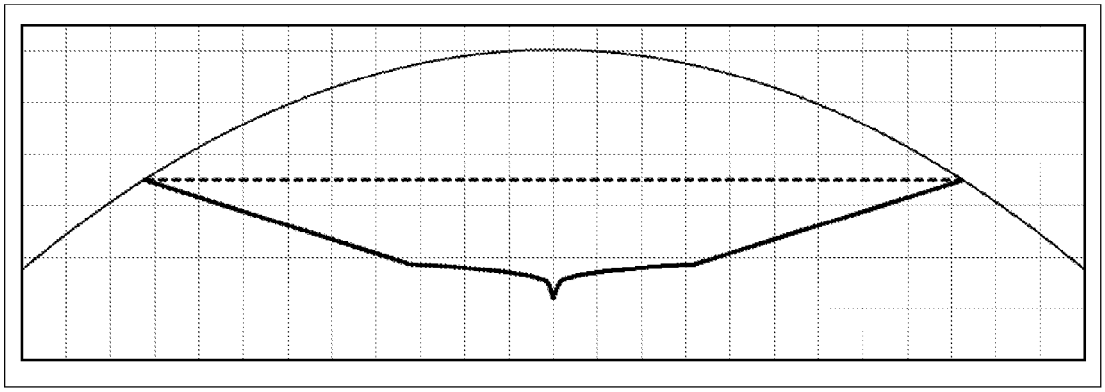
FIG. 8 shows a dimple cross-sectional shape according to another embodiment of the present invention.

FIGS. 6-8 show various dimple cross-sectional shapes having a base portion defined by a simple plane curve, such as a polynomial, trigonometric, hyperbolic, or exponential function. To define the base portion according to such functions, it should be taken into account that the chord plane of the dimple represents y=0 and the vertical axis in the center of the dimple represents x=0.

FIG. 6 illustrates a dimple profile resulting from a combination of a conical top portion and a base portion defined by a polynomial function: $y(x)=ax^2+bx+c$. The profile is then rotated 360° about the Y (vertical) axis to define the dimple surface. The highest order of the polynomial will dictate the overall shape of the base curve and the constants a, b, and c are used to modify the curvature intensity of the base curve. While FIG. 6 illustrates a base portion defined by a $2^{nd}$ order polynomial, it should be understood that a polynomial of any order and containing any number terms may be used.

FIG. 7 illustrates a dimple profile resulting from a combination of a conical top portion and a base portion defined by a trigonometric function: $y(x)=a\sin(bx^n)$. The profile is then rotated 360° about the Y (vertical) axis to define the dimple surface. While FIG. 7 illustrates a base portion defined by a sine function, it should be understood that any trigonometric or hyperbolic function may be used.

FIG. 8 illustrates a dimple profile resulting from a combination of a conical top portion and a base portion defined by an exponential function: $y(x)=ce^{x^n}$. The profile is then rotated 360° about the Y (vertical) axis to define the dimple surface. While FIG. 8 illustrates a base portion defined by a specific exponential function, it should be understood that any exponential function may be used.

In one embodiment, dimples of the present invention consist of a top conical sidewall, a bottom portion, and a transition surface that connects the top conical sidewall of the dimple to the land area of the ball. The dimples have an overall dimple diameter ($D_D$), a bottom portion diameter ($D_S$), and a transition diameter ($D_T$). The transition diameter is defined herein as the diameter at the point of intersection between the transition surface and the top conical sidewall. The portion of the overall dimple surface that is attributable to the transition surface is expressed by the transition ratio ($T_r$), which is defined by the equation $T_r=1-(D_T/D_D)$, where $D_T$ is the transition diameter and $D_D$ is the overall dimple diameter. In a particular aspect of this embodiment, the dimples have a transition ratio ($T_r$) of from 0.02 to 0.5. In another particular aspect of this embodiment, the dimples have a saucer ratio ($S_r$), defined as the ratio of the bottom portion diameter ($D_S$) to the overall dimple diameter ($D_D$), of from 0.05 to 0.75. In another particular aspect of this embodiment, the transition ratio is less than the saucer ratio, or the transition ratio is greater than the saucer ratio, or the transition ratio is equal to the saucer ratio.

The transition surface is defined by a function rotated about a central axis. The function defining the transition surface may result in an indistinct junction between the dimple surface and the land area, including, for example, embodiments wherein the transition surface is defined by a spherical arc. Thus, the process described herein and shown in FIG. 2 for measuring edge angle and dimple radius when the junction between the land area and dimple is not a sharp corner can be used to determine the overall dimple diameter of dimples that include a transition surface connecting the top conical sidewall of the dimple to the land area of the ball at an indistinct junction, with the exception of embodiments wherein the transition surface is defined by a linear function.

Figure 16:
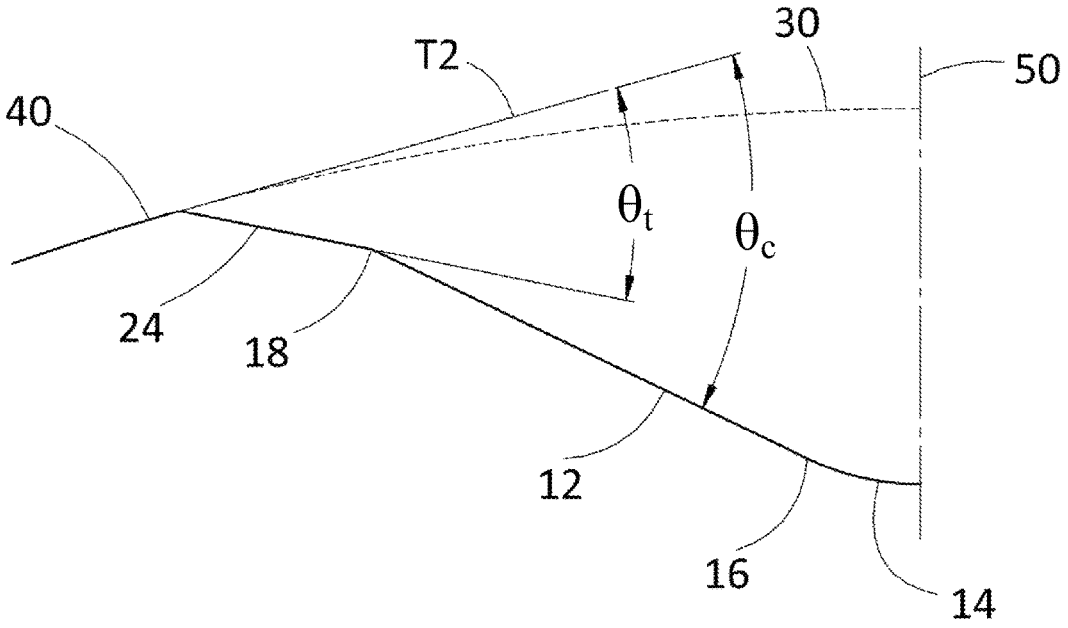
FIG. 16 is a schematic diagram illustrating a method for measuring the edge angle of a dimple having a transition surface that connects the top conical sidewall to the land area.

In embodiments of the present invention wherein the function defining the transition surface is a linear function, edge angle is determined as follows. Referring to FIG. 16, the edge angle of the transition surface ($\theta_t$) and the edge angle of the conical sidewall ($\theta_c$) are determined. The edge angle of the transition surface ($\theta_t$) is the angle between the conical transition surface 24 and the line T2 that is tangent with the ball surface at the dimple edge. The edge angle of the conical sidewall ($\theta_c$) is the angle between the conical sidewall 12 and the line T2 that is tangent with the ball surface at the dimple edge. The edge angle of the dimple ($\Phi_{EDGE}$) is then calculated as:

$$\Phi_{EDGE}=\theta_t(T_r)+\theta_c(1-T_r),$$

where Tr is the transition ratio, which is defined by the equation $T_r=1-(D_T/D_D)$, where $D_T$ is the transition diameter and $D_D$ is the overall dimple diameter.

Figure 13:
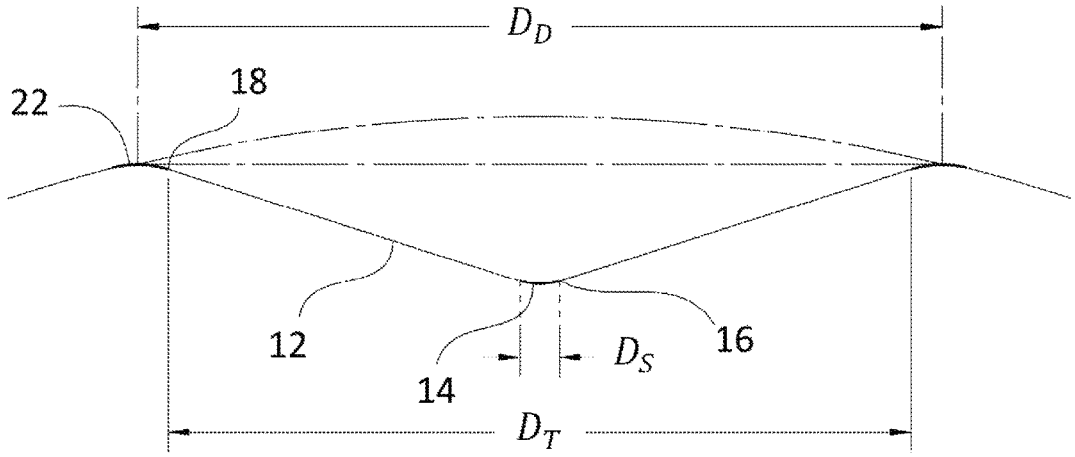
FIG. 13 is a schematic diagram illustrating a dimple profile according to an embodiment of the present invention.
Figure 14:
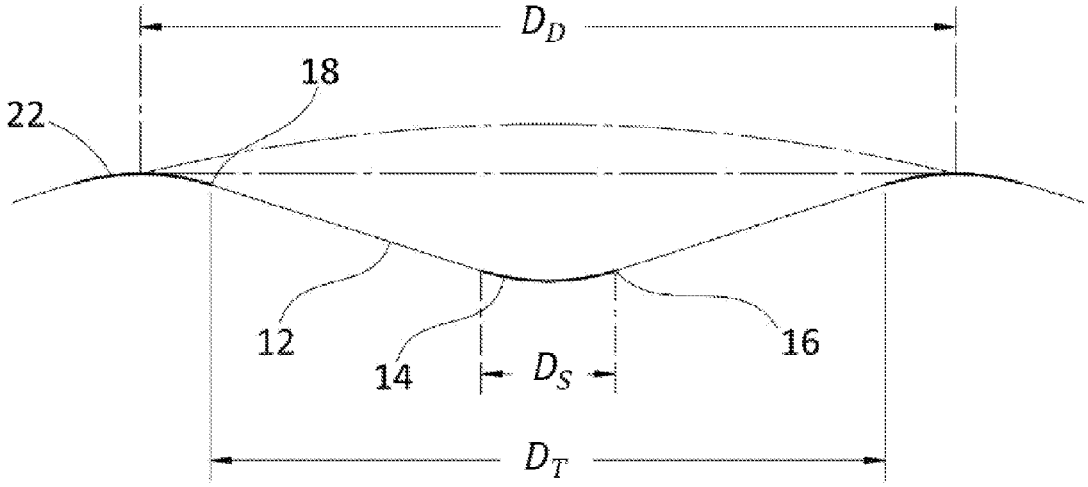
FIG. 14 is a schematic diagram illustrating a dimple profile according to an embodiment of the present invention.
Figure 15:
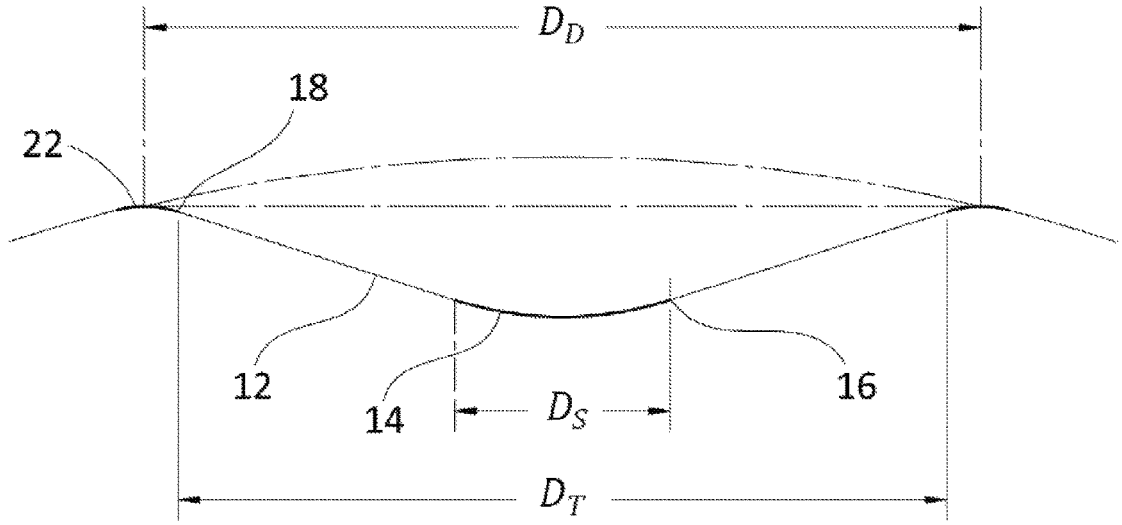
FIG. 15 is a schematic diagram illustrating a dimple profile according to an embodiment of the present invention.

FIGS. 13-15 illustrate several embodiments of dimples of the present invention which include a top conical sidewall 12, a bottom portion 14, and a transition surface 22 that connects the top conical sidewall 12 to the land area of the ball. The transition surface 22 intersects with the top conical sidewall 12 at a defined point of intersection 18. The top conical sidewall 12 intersects with the bottom portion 14 at a defined point of intersection 16. The dimple diameter ($D_D$), transition diameter ($D_T$), and saucer diameter ($D_S$) are identified. The transition surface 22 is defined by a spherical arc rotated about a central axis. The bottom portion 14 is a spherical cap.

In a particular aspect of the embodiments shown in FIGS. 13-15, the difference between the slope of the transition surface 22 and the slope of the top conical sidewall 12 at the point of intersection 18 is 2° or less. In another particular aspect of the embodiments shown in FIGS. 13-15, the difference between the slope of the top conical sidewall 12 and the slope of the bottom portion 14 at the point of intersection 16 is 2° or less. In the embodiment shown in FIG. 13, the saucer ratio ($S_r$) is about 0.05, and the transition ratio ($T_r$) is about 0.08. In the embodiment shown in FIG. 14, the saucer ratio ($S_r$) is about 0.16, and the transition ratio ($T_r$) is about 0.17. In the embodiment shown in FIG. 15, the saucer ratio ($S_r$) is about 0.26, and the transition ratio ($T_r$) is about 0.08.

Figure 17:
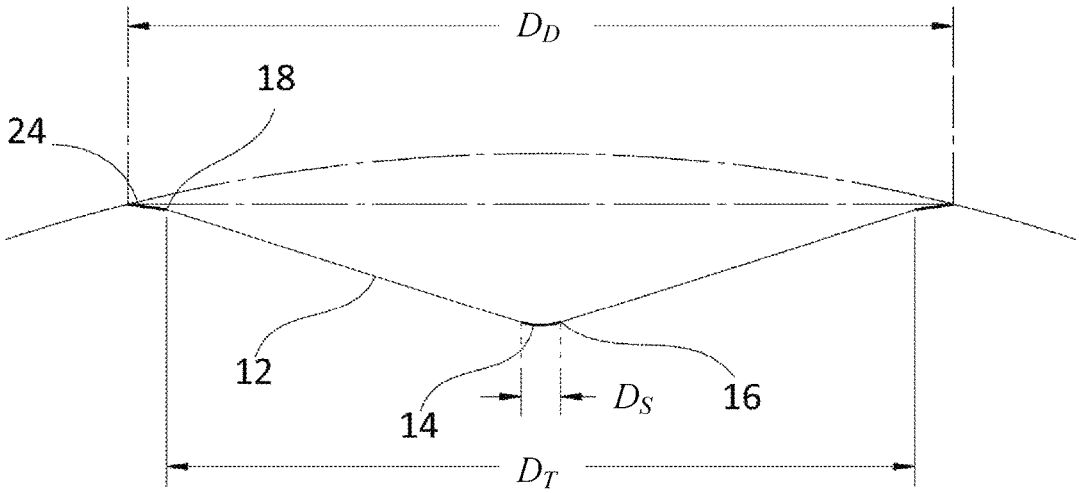
FIG. 17 is a schematic diagram illustrating a dimple profile according to an embodiment of the present invention.
Figure 18:
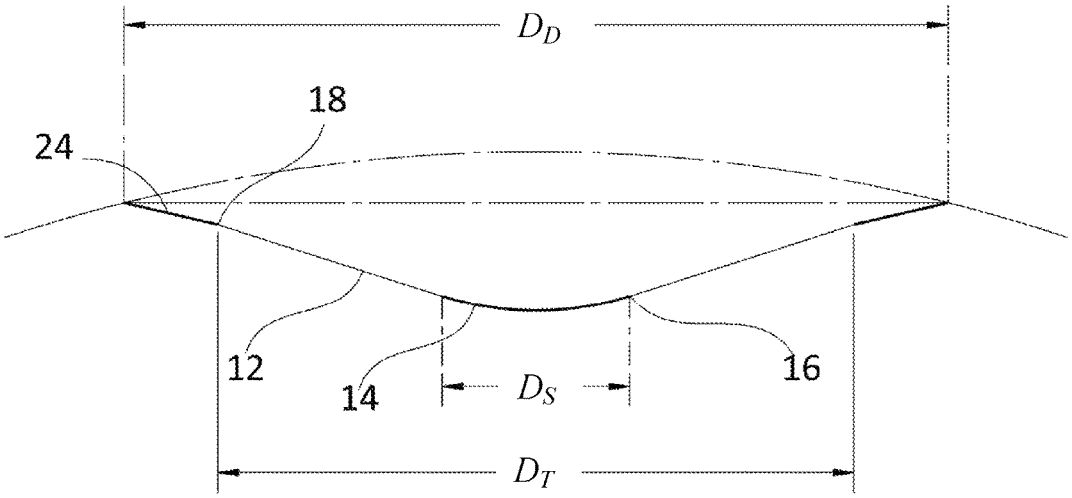
FIG. 18 is a schematic diagram illustrating a dimple profile according to an embodiment of the present invention.

FIGS. 16-18 illustrate several embodiments of dimples of the present invention which include a top conical sidewall 12, a bottom portion 14, and a transition surface 24 that connects the top conical sidewall 12 to the land area of the ball. The transition surface intersects with the top conical sidewall 12 at a defined point of intersection 18. The top conical sidewall 12 intersects with the bottom portion 14 at a defined point of intersection 16. The transition surface 24 is defined by a linear function rotated about a central axis. The bottom portion 14 is a spherical cap.

In a particular aspect of the embodiments shown in FIGS. 16-18, the difference between the slope of the transition surface 24 and the slope of the top conical sidewall 12 at the point of intersection 18 is 2° or less. In another particular aspect of the embodiments shown in FIGS. 16-18, the difference between the slope of the top conical sidewall 12 and the slope of the bottom portion 14 at the point of intersection 16 is 2° or less. In another particular aspect of the embodiments shown in FIGS. 16-18, the angular deviation between the transition surface 24 and the top conical sidewall 12 (i.e., the absolute value of $\theta_c-\theta_t$) is 2° or 4° or 6° or 8° or 10° or is within a range having a lower limit and an upper limit selected from these values.

In the embodiment shown in FIG. 17, the saucer ratio ($S_r$) is about 0.05, and the transition ratio ($T_r$) is about 0.09. The edge angle of the transition surface ($\theta_t$) is about 9.0° and the edge angle of the conical sidewall ($\theta_c$) is about 13.0°. Thus, the angular deviation between the transition surface 24 and the top conical sidewall 12 is about 4.0°, and the edge angle of the dimple ($\Phi_{EDGE}$) is calculated as:

$$\Phi_{EDGE}=\theta_t(T_r)+\theta_c(1-T_r), \text{ i.e.,}$$

$$\Phi_{EDGE}=9(0.09)+13(1-0.09)=12.64°.$$

In the embodiment shown in FIG. 18, the saucer ratio ($S_r$) is about 0.23, and the transition ratio ($T_r$) is about 0.23. The edge angle of the transition surface ($\theta_t$) is about 11.0° and the edge angle of the conical sidewall ($\theta_c$) is about 13.0°. Thus, the angular deviation between the transition surface 24 and the top conical sidewall 12 is about 2.0°, and the edge angle of the dimple ($\Phi_{EDGE}$) is calculated as:

$$\Phi_{EDGE}=\theta_t(T_r)+\theta_c(1-T_r), \text{ i.e.,}$$

$$\Phi_{EDGE}=11(0.23)+13(1-0.23)=12.54°.$$

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf ball having a generally spherical surface and comprising a plurality of dimples separated by a land area formed on the ball surface, wherein at least a portion of the dimples consist of a top conical sidewall, a bottom portion, and a transition surface that connects the top conical sidewall to the land area, wherein:

the bottom portion is defined by a function rotated about a central axis, the function being selected from the group consisting of polynomial, trigonometric, hyperbolic, exponential functions, and the superposition of two or more thereof, excluding linear functions and functions that result in a cone or sphere;

the transition surface is defined by a linear function rotated about a central axis;

the dimples consisting of a top conical sidewall, a bottom portion, and a transition surface have a saucer ratio ($S_r$), defined as the ratio of the bottom portion diameter ($D_S$) to the dimple diameter ($D_D$), of from about 0.05 to about 0.75; and the dimples consisting of a top conical sidewall, a bottom portion, and a transition surface have a transition ratio ($T_r$) of from 0.02 to 0.50, where the transition ratio ($T_r$) is defined by the equation $T_r=1-(D_T/D_D)$, where $D_D$ is the dimple diameter and $D_T$ is the diameter at the point of intersection between the transition surface and the top conical sidewall.

2. The golf ball of claim 1, wherein $T_r<S_r$.

3. The golf ball of claim 1, wherein $T_r>S_r$.

4. The golf ball of claim 1, wherein $T_r=S_r$.

5. The golf ball of claim 1, wherein there is a defined point of intersection between the transition surface and the top conical sidewall, wherein the difference between the slope of the transition surface and the slope of the top conical sidewall at the point of intersection is 2° or less.

6. The golf ball of claim 1, wherein there is a defined point of intersection between the top conical sidewall and the bottom portion, wherein a difference between the slope of the top conical sidewall and the slope of the bottom portion at the point of intersection is 2° or less.

7. The golf ball of claim 1, wherein the dimples have an edge angle ($\Phi_{EDGE}$) defined by $$1.33(S_r)^2-0.39(S_r)+10.40\leq\Phi_{EDGE}\leq2.85(S_r)^2-1.12(S_r)+13.49.$$

8. The golf ball of claim 1, wherein the dimples have a chord depth ($d_{CHORD}$) defined by $$0.0009(S_r)^2-0.0035(S_r)+0.0062\leq d_{CHORD}\leq0.0030(S_r)^2-0.0069(S_r)+0.0113.$$

9. A golf ball having a generally spherical surface and comprising a plurality of dimples separated by a land area formed on the ball surface, wherein at least a portion of the dimples consist of a top conical sidewall, a bottom spherical cap, and a transition surface that connects the top conical sidewall to the land area, wherein:

the transition surface is defined by a linear function rotated about a central axis;

the dimples consisting of a top conical sidewall, a bottom spherical cap, and a transition surface have a saucer ratio ($S_r$), defined as the ratio of the spherical cap diameter ($D_S$) to the dimple diameter ($D_D$), of from about 0.05 to about 0.75; and the dimples consisting of a top conical sidewall, a bottom spherical cap, and a transition surface have a transition ratio ($T_r$) of from 0.02 to 0.50, where the transition ratio ($T_r$) is defined by the equation $T_r=1-(D_T/D_D)$, where $D_D$ is the dimple diameter and $D_T$ is the diameter at the point of intersection between the transition surface and the top conical sidewall.

10. The golf ball of claim 9, wherein $T_r<S_r$.

11. The golf ball of claim 9, wherein $T_r>S_r$.

12. The golf ball of claim 9, wherein $T_r=S_r$.

13. The golf ball of claim 9, wherein there is a defined point of intersection between the transition surface and the top conical sidewall, wherein the difference between the slope of the transition surface and the slope of the top conical sidewall at the point of intersection is 2° or less.

14. The golf ball of claim 9, wherein there is a defined point of intersection between the top conical sidewall and the bottom portion, wherein a difference between the slope of the top conical sidewall and the slope of the bottom portion at the point of intersection is 2° or less.

15. The golf ball of claim 9, wherein the dimples have an edge angle ($\Phi_{EDGE}$) defined by $$1.33(S_r)^2-0.39(S_r)+10.40\leq\Phi_{EDGE}\leq2.85(S_r)^2-1.12(S_r)+13.49.$$

16. The golf ball of claim 9, wherein the dimples have a chord depth ($d_{CHORD}$) defined by $$0.0009(S_r)^2-0.0035(S_r)+0.0062\leq d_{CHORD}\leq0.0030(S_r)^2-0.0069(S_r)+0.0113.$$

* * * * *